United States Patent [19]

Fredriksen

[11] 3,945,657

[45] Mar. 23, 1976

[54] CROSS-COUNTRY TYPE SKI BINDING

[76] Inventor: Wilhelm Fredriksen, 19972 Mitchell, Detroit, Mich. 48234

[22] Filed: May 27, 1975

[21] Appl. No.: 580,964

[52] U.S. Cl. ..... 280/11.35 B

[51] Int. Cl.[2] ..... A63C 9/00

[58] Field of Search 280/11.35 B, 11.35 G, 11.35 T, 280/11.35 V, 11.35 L, 11.35 W, 11.35 Z

[56] References Cited

UNITED STATES PATENTS

| | | | |
|---|---|---|---|
| 3,481,618 | 12/1969 | With | 280/11.35 B |
| 3,612,558 | 10/1971 | Kjellstrom | 280/11.35 B |
| 3,715,127 | 2/1973 | With | 280/11.35 B |
| 3,823,953 | 7/1974 | With | 280/11.35 B |
| 3,850,439 | 11/1974 | Guttulsrud | 280/11.35 B |
| 3,861,700 | 1/1975 | Fredriksen | 280/11.35 B |

*Primary Examiner*—Robert R. Song
*Attorney, Agent, or Firm*—Whittemore, Hulbert & Belknap

[57] ABSTRACT

An improved cross-country type ski binding is provided. The ski binding comprises a toe iron, a clamp member pivotally mounted in said toe iron and a lock member pivotally mounted forwardly of said clamp member. The clamp member is fabricated of springy material. The lock member includes a pivotally mounted roller which is in obstructing relationship with respect to the free end of the clamp member. The clamp member is pivotable to a lowered clamping position wherein the free end thereof is beneath the roller which thereby locks the clamp member in its clamping position.

6 Claims, 4 Drawing Figures

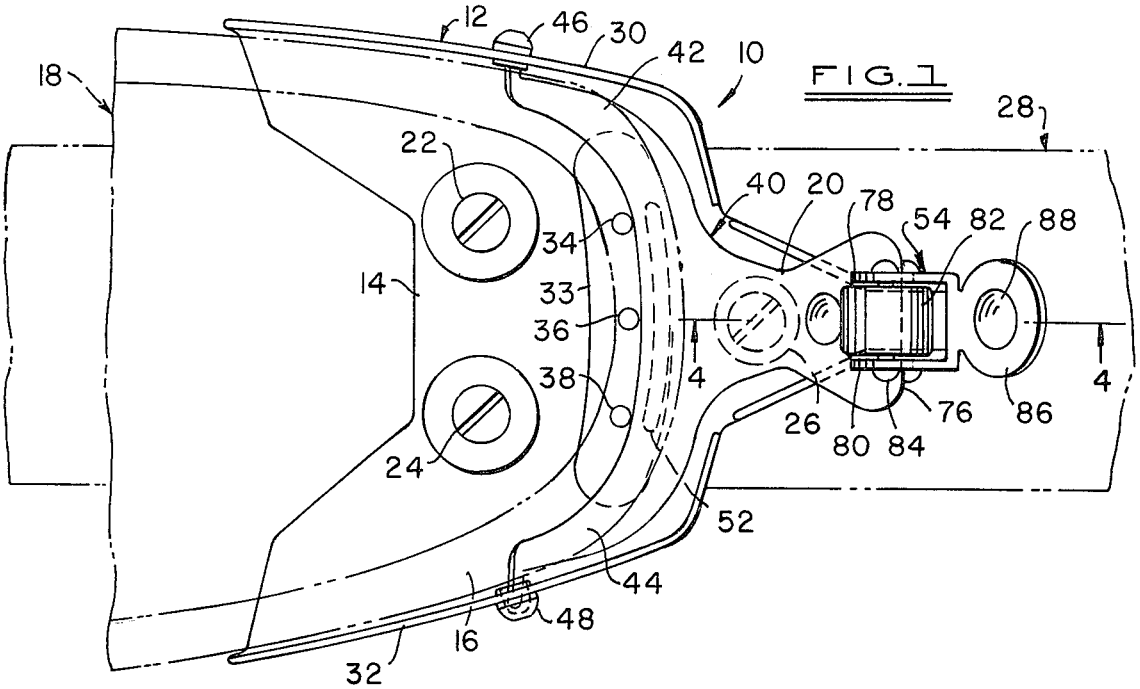
FIG. 1
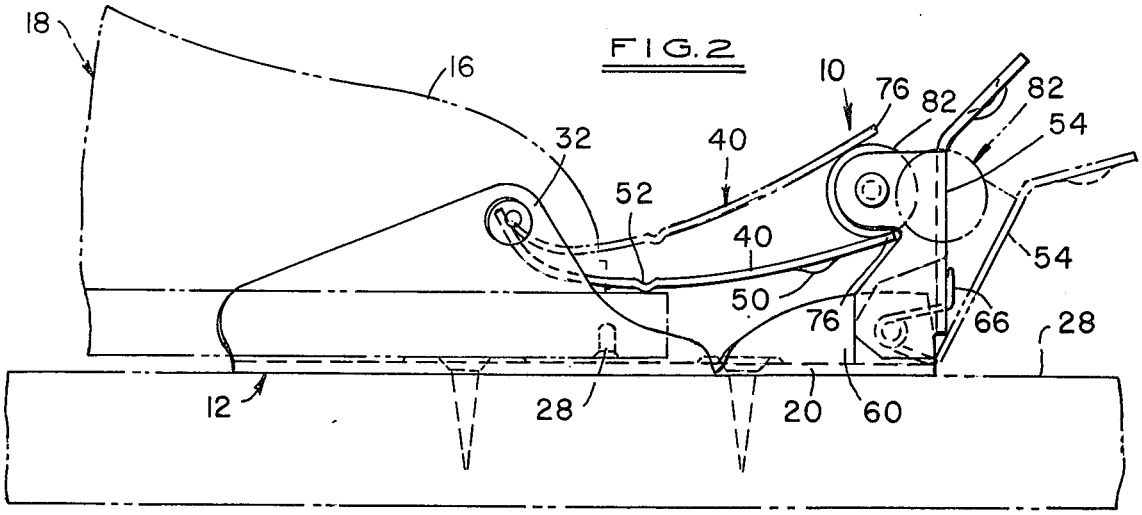
FIG. 2
FIG. 3
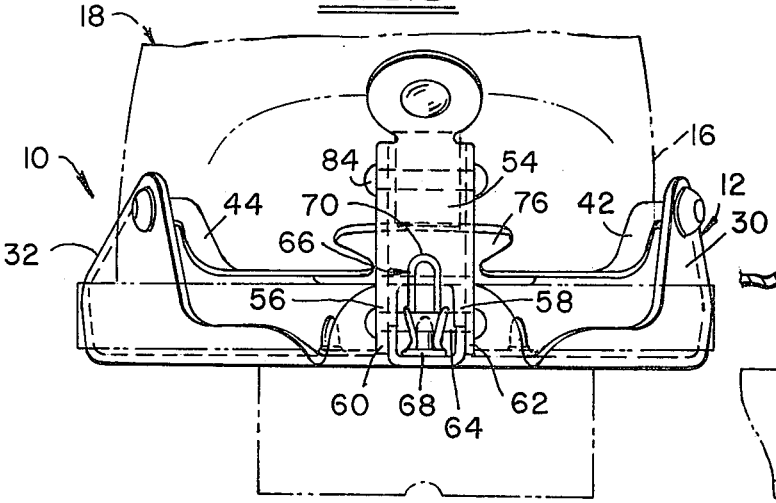
FIG. 4
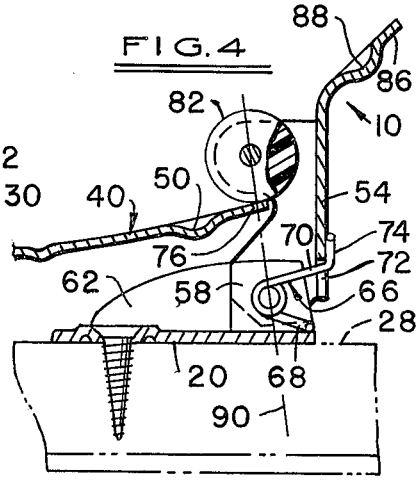

CROSS-COUNTRY TYPE SKI BINDING

BACKGROUND OF THE INVENTION

In my U.S. Pat. No. 3,861,700 and copending application Ser. No. 541,852, filed Jan. 17, 1975, I have disclosed improved cross-country type ski bindings which have desirable characteristics. The ski bindings disclosed in my patent and application each include a toe iron, a spring wire bail and a lock for the bail, both the bail and lock being pivotally mounted. In such structures, the toe of the ski boot is positively locked in the toe iron while still permitting maximum lift of the heel of ski boot. Means are provided on the bail and the lock forming a movable pivot axes which, in clamping, moves over-center with respect to the stationary pivot axes.

In my present invention, I have provided a modified construction wherein the clamp member and lock member are not mechanically connected to each other thereby minimizing potential failure of the structure as a result of disengagement of these two members. Additionally, a simple roller construction is provided on the lock member for engagement with the clamp member when the clamp member is pivoted to its lowermost clamping position. This construction incorporates a design wherein the outer end of the clamp member is positioned beneath the roller and extends beyond an imaginery line drawn between the pivot center of the roller and the pivot point of the lock member with the result that the clamp member, which exerts an upward spring force when in the clamping position, tends to cause the lock member to move further into locking position thus securely holding the clamp member in its clamping position.

SUMMARY OF THE INVENTION

The cross-country type ski binding includes a toe iron, a clamp member and a lock member for the clamp member..Both the clamp member and lock member are pivotally mounted via longitudinally spaced apart respective pivot axes. The clamp member is in the form of a springy lever. The clamp member is pivotable from a lowered, forwardly extending clamping position in which the clamp member presses down upon the sole adjacent the toe of a ski boot for clamping the latter in said toe iron to a raised, upwardly extending release position in which the ski boot is released from the toe iron. The lock member is positioned ahead of the clamp member. The lock member is pivotally mounted at its lower end as aforesaid. A roller is pivotally mounted on the upper portion of the lock member. The roller is in obstructing relationship with respect to the forward end of the clamp member whereby when the clamp member is pivoted downwardly the forward end thereof will engage the roller and cause the lock member to pivot forwardly until the forward end of the clamp member is positioned beneath the roller in its clamping position where the clamp member presses down upon the sole adjacent the toe of the ski boot. The clamp member is of a length whereby the forward end thereof extends beyond an imaginery line drawn through the pivot points of both the roller and the lock member with the lock member being pivoted to a position wherein the roller is positioned over the forward end of the clamp member in which position the clamp member exerts a pressure against the roller which tends to pivot the lock member rearwardly into secure locking relationship with the clamp member.

IN THE DRAWINGS

FIG. 1 is a top plan view of one embodiment of the cross-country type ski binding of the present invention illustratively mounted on a ski;

FIG. 2 is a side elevational view of the ski binding of FIG. 1;

FIG. 3 is a front end view of the ski binding of FIG. 1; and

FIG. 4 is a sectional view taken substantially along the line 4—4 of FIG. 1 looking in the direction of the arrows.

The cross-country type ski binding 10 of the present invention includes a toe iron 12 which includes a substantially flat plate portion 14 upon which the toe portion 16 of a ski boot 18 is adapted to rest. An extension 20 extends forwardly from the plate portion 14. The toe iron 12 has three openings through which extend screws 22, 24, 26 to secure the toe iron to a ski 28. Upstanding wall portions 30, 32 define a structure for wedging the toe portion 16 of the boot 18 securely in place. A plate 33 having three upstanding pins 34, 36, 38 is secured to the plate portion 14. The pins are received in openings conventionally provided on the underside of the toe portion 16. The function of the pins 34, 36, 38 is to releasably engage the toe portion of the ski boot.

A clamp member in the form of a lever 40 having a pair of spaced apart rearwardly extending arms 42, 44 is pivotally mounted in the toe iron by means of journals 46, 48. The member 40 is fabricated of a springy material so that it will act as a spring. A recess 50 is provided in the forward end of the lever 40 for engagement by the tip of a ski pole to push the lever downwardly to a forwardly extending clamping position in which the clamp member presses down upon the sole adjacent the toe of the ski boot to lock the toe of the ski boot in the toe iron 12. This permits the skier to conveniently lock his boots in place without bending over. It will be noted that an elongated recess 52 is provided in the lever 40 for positive engagement of the upper surface of the ski boot sole. The lever 40 is fabricated of a springy metal so that when it is pivoted to its lowermost ski boot engaging position as illustrated in FIG. 2, the lever will exert an upward force tending to disengage it from the ski boot.

Means are provided to retain the lever 40 in the lower clamping position as shown in solid lines in the figures. These means comprise a pivotal lock member in the form of a lever 54 having spaced apart lower tab 56, 58 which are pivotally attached to forward upwardly extending tab portions 60, 62 of the extension 20 by means of a pin 64. Spacing apart of tab portions 60, 62 results in a two point mounting which gives lateral stability to the mounting. A spring 66 is provided in the pin 64. The spring has one arm 68 which bears against the toe plate and another arm 70 which extends through opening 72 of lever 54. The arm 70 terminates in an upturned portion 74 which bears against the lever 54 thereby biasing the lever 54 in the counter-clockwise position as viewed in FIG. 4. The spring 66 maintains the lever 54 in the generally upright position which facilitates engagement with the outer end 76 of the lever 40.

The lever 54 has a second pair of spaced apart tabs 78, 80 on the upper portion thereof. A resilient roller 82 is pivotally mounted between tabs 70, 80 by means of a pin 84. The lever 54 has an upper forwardly angled portion 86 provided with a recess 88 for engagement with the tip of a ski pole for the purpose of unlatching the binding. Again, this permits the skier to conveniently unlatch his boots without bending over.

Operation of the ski binding 10 may be understood by reference to FIGS. 2 and 4. Referring to FIG. 2, it will be noted that when the ski binding is unlatched, the lever 40, shown in dotted lines, is in a position above the roller 82. Downward pressure on lever 40 will cause the lever 54 to pivot forwardly as shown in dotted lines in FIG. 2. The rolling action of the roller 82 facilitates this movement. When the outer end 76 of the lever 40 passes beneath the roller 82, the lever 54 is biased rearwardly by means of spring 66 to the position shown in solid lines. In this position, as illustrated in FIG. 4, the outer end of the lever 40 passes over center of the fixed pivot points of the roller 82 and lever 54 as defined by, respectively, the pins 84, 64 as shown by the dotted line 90 in FIG. 4. In this position, the upward force exerted by the springy lever 40 exerts a force against the roller 82 which tends to bias the lever 54 in the counter-clockwise position as viewed in FIG. 4. This action tends to firmly engage the levers 40, 54. The end 86 of lever 40 and the roller 82 are relatively broad to provide substantial line contact between these elements. The levers are disengaged by physically pressing the lever 54 downwardly as shown in dotted lines in FIG. 2. As soon as the outer end of the lever 40 passes beyond the line 90, the lever 54 will tend to pivot the lever 54 in the clockwise direction as viewed in FIG. 4 to thereby disengage the lever for unclamping of a ski boot. In practice, as soon as the other end of the lever 40 passes beyond line 90 there is sudden disengagement of the lever as a consequence of the springyness of lever 40. The situation is analagous to an overcenter spring clamping device having a movable pivot point and a pair of fixed pivot points with the pivot points of the roller 82 and lever 54 being fixed and the contact of the outer end of lever 40 with roller 82 being a movable pivot point.

Having thus described my invention, I claim:

1. A cross-country type ski binding comprising a toe iron, a clamp member and a lock member for the clamp member both pivotally mounted via longitudinally spaced apart respective pivot axes, said clamp member being in the form of a springy lever, said clamp member being pivotable from a lowered, forwardly extending clamping position in which the clamp member presses down upon the sole adjacent the toe of a ski boot for clamping the latter in said toe iron to a raised, upwardly extending release position in which the ski boot is released from said toe iron, the lock member being positioned ahead of said clamp member, said lock member being pivotally mounted at its lower end as aforesaid, a roller pivotally mounted on the upper portion of the lock member, said roller being in obstructing relationship with respect to the forward end of the clamp member whereby when said clamp member is pivoted downwardly the forward end thereof will engage the roller and cause the lock member to pivot forwardly until the forward end of the clamp member is positioned beneath the roller in its clamping position where said clamp member presses down upon the sole adjacent the toe of a ski boot, said clamp member being of a length whereby the forward end thereof extends beyond an imaginery line drawn through the pivot points of both the roller and the lock member with the lock member being pivoted to a position wherein the roller is positioned over the forward end of the clamp member in which position the clamp member exerts an upward spring pressure against the roller which tends to pivot the lock member rearwardly into secure locking relationship with the clamp member. forward

2. A cross-country type ski binding as defined in claim 1, further characterized in the provision of spring means on the lock member biasing the lock member rearwardly to automatically position the roller in obstructing relationship with respect to the forwad end of the clamp member.

3. A cross-country type ski binding as defined in claim 1, further characterized in that said lock member has a pair of spaced apart tabs on the lower portion thereof, each tab being pivotally mounted to define the stationary pivot axis of the lock member.

4. A cross-country type ski binding as defined in claim 1, further characterized in that said forward end of the clamp member and said roller are relatively broad to provide substantial line contact between said elements when the clamp member is in its lowermost clamping position.

5. A cross-country type ski binding as defined in claim 1, further characterized in that said clamp member includes a pair of spaced apart rearwardly extending arms, each arm being pivotally mounted to the toe iron at the rearward end thereof.

6. A cross-country type ski binding as defined in claim 1, further characterized in that said lock member includes a pair of rearwardly extending spaced apart tabs on the upper portion thereof, said roller being received between said tabs, and pin means extending through said tabs and roller to pivotally mount the roller.

* * * * *